US006581415B2

(12) United States Patent
Chandra et al.

(10) Patent No.: US 6,581,415 B2
(45) Date of Patent: Jun. 24, 2003

(54) METHOD OF PRODUCING SHAPED BODIES OF SEMICONDUCTOR MATERIALS

(75) Inventors: Mohan Chandra, Merrimack, NH (US); Yuepeng Wan, Nashua, NH (US)

(73) Assignee: G.T. Equipment Technologies, Inc., Nashua, NH (US)

( * ) Notice: Subject to any disclaimer, the term of this patent is extended or adjusted under 35 U.S.C. 154(b) by 47 days.

(21) Appl. No.: 09/933,342

(22) Filed: Aug. 20, 2001

(65) Prior Publication Data

US 2002/0115273 A1 Aug. 22, 2002

Related U.S. Application Data

(60) Provisional application No. 60/265,806, filed on Jan. 31, 2001.

(51) Int. Cl.[7] ..... B28D 23/00

(52) U.S. Cl. ..... 65/66; 164/46; 264/483; 264/309; 264/317; 438/97

(58) Field of Search ..... 65/66, 302; 164/46; 264/483, 309, 317; 438/97

(56) References Cited

U.S. PATENT DOCUMENTS

| | | | | |
|---|---|---|---|---|
| 3,139,363 A | | 6/1964 | Baldrey | |
| 3,686,378 A | | 8/1972 | Dietze | |
| 3,867,497 A | | 2/1975 | Teich et al. | |
| 3,900,039 A | | 8/1975 | Dietze et al. | |
| 3,917,782 A | | 11/1975 | Holocomb et al. | |
| 4,003,770 A | | 1/1977 | Janowiecki et al. | |
| 4,011,076 A | | 3/1977 | Hovis, Jr. et al. | |
| 4,537,742 A | * | 8/1985 | Siemers et al. | 419/8 |
| 5,126,529 A | | 6/1992 | Weiss et al. | |
| 5,731,030 A | * | 3/1998 | Friese et al. | 427/8 |

FOREIGN PATENT DOCUMENTS

| | | | |
|---|---|---|---|
| EP | 0 305 142 | * | 3/1989 |
| JP | 404116107 A | | 4/1992 |
| WO | WO 00/49199 | | 8/2000 |

OTHER PUBLICATIONS

PCT International Search Report dated Jan. 25, 2002 of International Application No. PCT/US01/25974 filed Aug. 20, 2001.

Herbert Herman, Plasma–sprayed Coatings, Scientific American, Sep. 1988, pp. 112–117, vol. 256, No. 9.

* cited by examiner

*Primary Examiner*—James Derrington
(74) *Attorney, Agent, or Firm*—Maine & Asmus

(57) ABSTRACT

A method for producing formed semiconductor articles with predefined shapes such as core tubes for CVD production of bulk polysilicon. The method is characterized by thermal spray deposition of the semiconductor material in a on a temperature controlled rotating mandrel that is shaped complementarily to the desired article shape, and by later separation of the formed semiconductor body from the mandrel by thermal contraction, melting, or chemical reduction of the mandrel size.

18 Claims, 1 Drawing Sheet

METHOD OF PRODUCING SHAPED BODIES OF SEMICONDUCTOR MATERIALS

This application claims priority for all purposes to pending U.S. application serial No. 60/265,806, filed Jan. 31, 2001.

TECHNICAL FIELD OF THE INVENTION

This invention relates generally to the fabrication of bodies of semiconductor materials. The invention particularly relates to production of formed articles of semiconductor material which are useful in diffusion doping processes, epitaxial growth of semiconductor material, and chemical vapor deposition processes for pure polysilicon production and other related deposition methods widely used in the semiconductor industry.

BACKGROUND OF THE INVENTION

One of the main applications of tubular bodies of semiconductor material, particularly of silicon, is the processing vessel for the manufacturing of semiconductor components, especially in the manufacture of epitaxial layers through a transport reaction, and in the doping process of semiconductor wafer in a diffusion furnace. In such a processing furnace, semiconductor crystals are disposed in the interior of the tube and heated up together with the tube to a desired temperature at which the doping or epitaxial precipitation process takes place.

There is another emerging application of silicon tubes in the fabrication of pure polysilicon by chemical vapor deposition (CVD) method. According to a new process disclosed by Chandra et al. (U.S. patent application Ser. No. 09/642,735), silicon tubes with large surface area are used as the deposition substrates to replace the silicon slim rod used conventionally in a CVD reactor for polysilicon production. The major benefit of using silicon tubes in the reactor is the significant increase in the production rate, especially during the initial deposition period. This new technology calls for an economical way of producing the starting silicon tubes.

The above mentioned semiconductor tubes, both for diffusion furnaces and CVD reactors, would seem to be relatively large, in the planned fabrication of semiconductors. The size of the semiconductor tube or ampoule is designated according to the diameter and the number of the wafers to be processed. For 125 mm diameter wafers, for example, the tube can have an inner diameter of about 160 mm, with a wall thickness of about 8 mm and the tube length of about 2000 mm. Both applications require a stringent high purity of the semiconductor tubes, as generally expected for semiconductor grade materials. The wall of the tube should be gas tight to prevent any leakage of the reactive gases. This restrains any form of cracks inside the wall of the semiconductor body. The tube is also supposed to be strong enough so that mechanical handling would not break or destroy it during its utilization.

The prior art of producing semiconductor bodies, particularly silicon tubes, can be roughly divided into two categories, according essentially to the deposition or growth of the semiconductor material. One is the chemical vapor deposition (CVD) of semiconductor materials, and the other one is the crystal growth through Edge-defined Film-fed Growth (EFG) method.

The CVD process is the most commonly used method for producing semiconductor bodies. In this method, a thermally decomposable gaseous semiconductor compound is brought into contact with heated surfaces of a carrier member or mold, and decomposed to yield a semiconductor material which is deposited on the carrier member surfaces. After the deposition process is completed, the system is cooled and the carrier member is removed without destroying the formed semiconductor body. Variations of this method differ only in the technique of removing the carrier member, which is mostly made of graphite according to the related literature, although the use of metallic carrier members were also reported, for example, tantalum in U.S. Pat. No. 3,139,363.

Methods for removing graphite mold include burning out the graphite material, dissolving graphite in fuming nitric or chromosulfuric acid, see for example U.S. Pat. No. 3,900,039, and pulling the carrier member out of the resulting cooled semiconductor body by forming fissures or cracks at the initial deposition stage at a elevated temperature, see also U.S. Pat. No. 3,686,378, or by depositing three successive layers of $SiO_2$, amorphous silicon, and polycrystalline silicon, as described in U.S. Pat. No. 3,867,497.

The major problem related to the above-mentioned CVD method is the extremely high cost of the process, both on deposition and mandrel removal. The high deposition temperature, about 800–1200° C., limits the selection of the mold materials which need to be refractory. Although techniques for a reusable carrier member, which could reduce the overall cost of the tubes, have been reported, problems related to the tubes made therefrom, such as the complexity of the associated process, and leaks during the utilization due to the minute discontinuities in the semiconductor body, are still formidable.

The EFG method for producing silicon tubes is a technique or method invented and developed by La Belle, see U.S. Pat. No. 3,591,348, and has been applied mainly for solar cell manufacturing. This technique employs a shaped crucible, which acts as a shaping die with capillary slots built into the walls, and produces monocrystalline silicon ribbons and tubes with different shapes. It was explored recently by Chandra et al, in U.S. patent application Ser. No. 09/642,735, as an approach to produce the starting silicon tubes used in their new CVD reactors.

The EFG crystal growth technique is a high temperature process with melting and freezing of silicon material. High thermal stress can build up inside the tube, which leads to easy breakage of the tube. The tube wall is generally thin and very brittle. These drawbacks of the EFG tubes preclude their application in the diffusion furnaces.

In the disclosure that follows, we present a new method for the forming of semiconductor articles, particularly silicon tubes for the above mentioned applications. This new method applies the general thermal spray technique, which has seen an extensive application in coating and net-shape forming of metal and ceramic materials. Readers may find instructive an article written by Herman, entitled "Plasma-sprayed Coatings", *Scientific American*, vol. 256, no. 9, September, 1998, pp. 112–117. However, no application of this technique for the forming of pure semiconductor articles, such as high purity silicon or germanium tubes, has to our knowledge been reported.

SUMMARY OF THE INVENTION

The present invention is directed to a method for producing formed semiconductor bodies, particularly full form bodies of silicon and germanium, whether pure or doped, which are used either as process vessels in diffusion furnaces for semiconductor devices or as starting substrates in chemical vapor deposition reactors for polysilicon or germanium manufacturing. In this method, a thermal spray torch, an arc plasma torch, for example, is used to generate high temperature and high-speed gas jet. Semiconductor materials that are usually in powder form are fed into the jet. Powder particles are melted/softened and accelerated by the jet, and thereafter, impact and deposit on a pre-shaped mandrel to form the desired coating layer of the semiconductor. The coating layer formed this way is, thereafter, separated from the supporting mandrel either by pulling out the mandrel mechanically or by dissolving the mandrel material into liquid chemicals or depleting the mandrel with gaseous oxidants.

Two of the major advantages of this method are the high production rate and low cost per tube comparing to both the CVD and crystal growth methods. Moreover, unlike the mandrel materials used in CVD deposition, which are limited by the high deposition temperatures, typically about 800–1200° C., there is much broader selection of the mandrel materials for the thermal spray deposition process because the deposition temperature can be much lower, less than 400° C., or even 200° C., and can be easily manipulated.

Another benefit of the lower deposition temperatures is the weaker adhesion between the coating layer and the mandrel surface, which leads to easier separation of the formed article from the mandrel. Also, the thermal stress inside the spray formed body is much smaller than that formed at high deposition temperature, such as in a CVD reactor or crystal growth from melt. The thermal spray system lends itself to deposit more than one material simultaneously, which opens a venue for putting dopant into the semiconductor body.

It is, therefore, an object of the invention to provide a method for the fabrication of shaped bodies of semiconductor materials, including tubular body shapes.

Another object of the invention is to provide a method for fabrication of semiconductor bodies with high purity.

A further object of the present invention is to provide a method to form these bodies on a supporting mandrel, and to be further able to release the body from the mandrel without endangering the soundness or quality of the semiconductor body.

A yet further object of the invention is to confine mandrel temperature exposure to not more than 400° C. and preferably not more than 200° C. during the formation process.

A still yet further object is to provide for the addition of dopants in the materials of which the semiconductor body is formed.

Other objects, advantages and preferred embodiments of the invention will be apparent from the following detailed description.

DESCRIPTION OF THE PREFERRED EMBODIMENT

Figure 1:
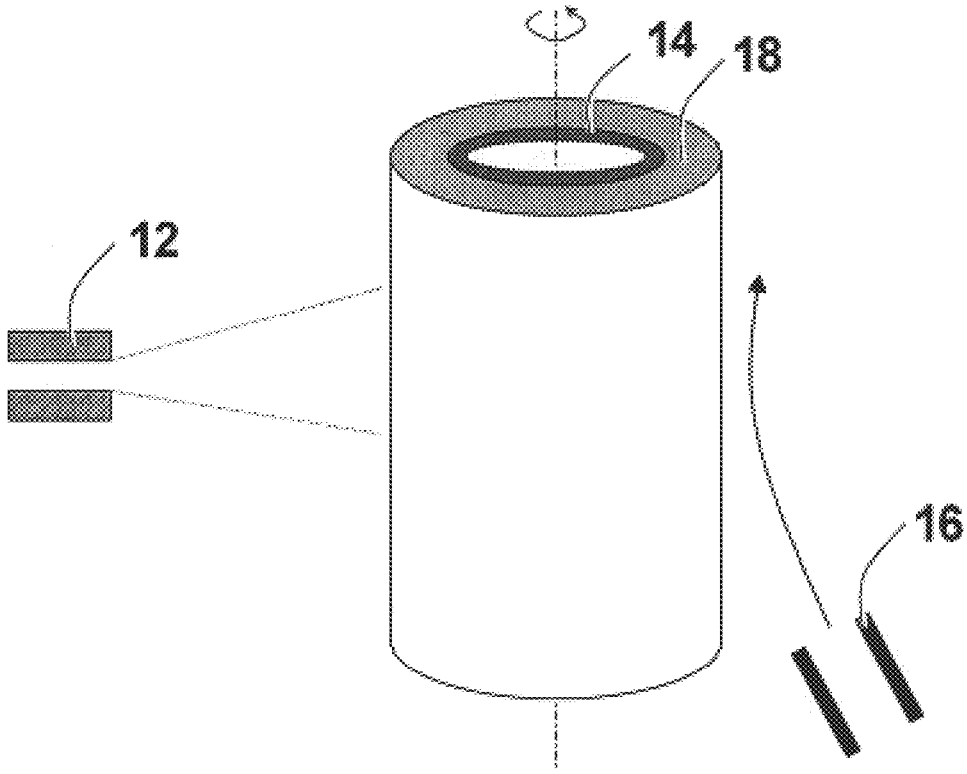
FIG. 1 illustrates a thermal spray deposition methodology and system for forming a tubular semiconductor body on a mandrel in accordance with the present invention.

In accordance with the present invention, the process for making a semiconductor article consists of two major steps. The first step is the forming of the semiconductor article by thermally sprayed deposition of a powdered form of the semiconductor material on to a mandrel of complimentary form under controlled conditions. The second step is the releasing of the semiconductor article from the mandrel. The invention being susceptible of many variations; what follows is only a preferred embodiment, and should not be construed as limiting of the invention.

Referring to FIG. 1, a system for thermal spray deposition of semiconductor materials consists of thermal spray torch 12, preferably plasma torch, mandrel 14 with predefined shape such as a cylinder for a tubular body as show in FIG. 1, and a gaseous cooling jet 16. During the spray deposition process, a continuous stream of semiconductor powder such as silicon or geranium, in this case silicon, is fed into the high-temperature, high-speed flame generated by the thermal spray torch 12. These powders are heated up and accelerated rapidly by the flame. Most of them are melted or softened in the flame, and then impact and deposit on the surface of the mandrel 14 or of the previously deposited semiconductor layer 18.

The mandrel is mounted on a shaft, not shown on the FIGURE, and set to a constant rotation speed, 60 rpm in this embodiment. The rotation of the mandrel results in a uniform deposition layer 18 of the semiconductor material continuously building up around the mandrel by the impacting powders. To keep a low surface temperature at the coating surface, a cooling jet 16 may be used, which directs cooling gas across the surface of the coating layer 18 as the mandrel rotates. To obtain a semiconductor article or body with low content of oxygen, the spray deposition system and process illustrated in FIG. 1 can be placed in a low pressure or inert, oxygen-free environment.

The thermal spray torch 12 can be any of several arts, such as a plasma spray gun, flame gun, high-velocity oxygen and fuel (HVOF) gun, etc., depending on the semiconductor material to be sprayed and the requirements of the microstructure and purity of the finished body, but a plasma spray torch is preferable. Generally, a plasma torch generates a plasma jet with very high temperature, about 14000 degrees Kelvin at the nozzle exit, which is advantageous for melting and softening materials with high melting points, such as silicon. Additionally, a plasma torch uses inert gases as the main plasma gas, such as argon, helium, and nitrogen, sometimes with a small portion of hydrogen as the secondary gas. Therefore, a plasma torch produces the least oxide in the coating layer 18, when the spray system is placed inside a vacuum or inert gas environment.

The semiconductor powders to be sprayed should have a purity level in accordance with the purity requirement of the finished body. Powders should be flowable inside the powder feeding system and sprayable in the spray deposition system, which is mainly determined by the size and shape of the powder to be sprayed. The preferable size of the powder is about 50–100 $\mu$m for silicon material, for example.

The use of the cooling jet 16 is optional. The main purpose is to keep the temperature of the deposition surface at a relatively low level, preferably 200 to 400 degrees Centigrade, and in this example below 200 degrees Centigrade, which helps to prevent; 1) the possible melting of the mandrel material, 2) the high thermal stress inside the semiconductor body, and 3) cracking of the body caused by the strong adhesion and high thermal mismatch between the coating layer 18 and the mandrel 14 at high temperature. To avoid unnecessary reaction between the cooling gas and the coating layer 18, an inert gas, such as argon or nitrogen, is preferred.

The selection of the mandrel material 14 is critical for the successful forming of the desired semiconductor article. One of the main factors to be considered is the matching of the thermal expansion coefficients of both the mandrel material and the semiconductor material, in order to minimize the thermal stress so that no cracks appear in the deposited layer 18 during spraying and cooling procedures. The preferred temperature range of consideration for comparing the thermal expansion characteristics of the mandrel to the semiconductor material is from room temperature to process temperature, about 200° C., is much lower than that in a vapor deposition system. As will be seen below, it is not required that the expansion characteristics be the same.

Another major factor for the mandrel material selection is that the formed article or body should be able to be separated from the mandrel. There are several ways to accomplish this requirement. The most preferable method is to release the body mechanically by a more significant contraction of the mandrel during the cool-down of the coated part, due to its higher coefficient of expansion. This works, for example, when an internal or male mold mandrel has a uniform cross section over its length, or a taper from a small end to a larger end, that permits the mandrel to be withdrawn from the deposited body without interference, after a sufficient cool down contraction of the mandrel has occurred, breaking the bond between the semiconductor body and the mandrel surface. With this technique, the mandrel is frequently reusable.

Another way to release the formed body is to use a mandrel material with a very low melting point, but still higher than the process temperature, of course. The low melt point material can be used for the entire mandrel, or as a surface layer over a more durable mandrel core member, for providing the final shape or profile to the finished mandrel. This technique is useful where the mandrel shape would otherwise cause an interference with simple extraction of the mandrel from the deposited body. After the body is formed, the mandrel and body are heated so as to melt the mandrel or at least the interference portion or surface layer of the mandrel shape, without placing significant additional thermal stress on the deposited body. The mandrel core and melted mandrel material can be used to form a new mandrel for another deposition cycle.

Yet another method for the separation of the semiconductor article and the mandrel is to leach out or dissolve the mandrel material with chemicals, such acids and alkalis, or by reactions such as burning of the mandrel. There is a wide selection of candidate mandrel materials and chemicals for this method. As above, a compound mandrel assembly having an impervious core member and a chemically reducible outer layer that defines the shape, can be used. The different separation methods will be further exemplified in the following examples.

EXAMPLE 1

A polysilicon tube with an inner diameter of six centimeters, wall thickness of about two millimeters and length of about 10 centimeters, was formed by plasma spraying of polysilicon powders on to a mandrel made of cast steel. The steel tube has an outer diameter of six centimeters, a thickness of about 1.5 millimeters and length of about 10 centimeters.

The spraying deposition was performed in an atmospheric environment. The polysilicon powder used for the spray was about 99.9% in purity with about 300 ppmwt of Fe, 610 ppmwt of Al, and 100 ppmwt of Ca. A DC plasma spray gun of about 80 kilowatts was used with the standoff between the gun exit to the mandrel surface held at about five centimeters. The gun was sweep up and down along surface of the mandrel while the mandrel was rotated around its vertical axis. The surface temperature was kept at about 100 to 120° C. during spraying by a cooling air jet. A layer of about 25 μm thickness of silicon was deposited on the surface during each pass of the spray gun. The process was conducted for about 40 minutes.

The spray-formed polysilicon article and mandrel were allowed to cool down naturally to room temperature in air after spraying. No cracks were recognized at the surface of the silicon article. The whole piece, article and mandrel, was then immersed into a bath of hydrochloric acid to leach out the mandrel material. After about 5 hours, the mandrel was dissolved completely and the polysilicon tube was obtained.

EXAMPLE 2

A second polysilicon tube was plasma spray formed by using a metal rod with low melting point as the supporting mandrel. The silicon tube was about four centimeters long with an inner diameter of about two centimeters and wall thickness of about one millimeter. The mandrel material was a Wood's alloy of about 12.5% Sn+25.0% Pb–50% Bi+12.5% Cd, with a melting point of about 70–88° C. Silicon powder and spray conditions were substantially the same as in EXAMPLE 1. To prevent the melting of the mandrel material, the standoff between the torch and the mandrel surface was increased from about five centimeters to about 7.6 centimeters.

After the coating of silicon layer was applied to the mandrel, the sprayed piece was allowed to cool down naturally in air for several hours. No cracks were observed in the formed semiconductor body. The cooled work piece was then put into a bath of boiling water to melt down the mandrel. A polysilicon tube clear of the mandrel material was obtained from the boiling bath.

The invention is capable of other embodiments. For example, there is a method for manufacturing a formed article of semiconductor material that includes the steps of fabricating a mandrel with a forming surface conforming to the desired shape of the article, keeping the forming surface in continuous motion with respect to a thermal spray apparatus such as by rotating it on its axis or by moving it or the spray apparatus with angular or linear reciprocating motion, supplying the thermal spray apparatus with a powdered form of semiconductor material, depositing with the thermal spray apparatus a continuous layer of the semiconductor material on the moving forming surface until the formed article is fully formed and complete on the mandrel, and then separating the formed article from the mandrel.

The step of depositing may include maintaining the continuous layer at not more than about 400 degrees Centigrade, in order to avoid excessive thermal stress, by using a cooling stream of air or inert gas. The step of depositing may go further by maintaining the continuous layer on the mandrel at not more than about 200° C., so as to reduce thermal stresses even more.

The mandrel may be fabricated of materials having a higher coefficient of thermal expansion than the semiconductor material within the temperature range of about room temperature to about 200° C., or what ever the continuous layer is being controlled at, and the step of separating may work by thermally contracting the forming surface of the mandrel away from the formed article by cooling effects.

The semiconductor material may be composed substantially of silicon or germanium, relatively pure or doped. The formed article may, for example, be a hollow tubular shaped article with both ends open, or a tubular article with one end open and one end closed, or a bowl-shaped article, other shapes not being excluded.

The mandrel may be fabricated with the forming surface as an outer layer upon a mandrel spindle, enabling a common spindle to be used with different forming surface profiles to achieve different formed articles.

The mandrel may be made of materials having a substantially lower melting point than the formed article, so that the step of separating the article from the mandrel can include the melting of at least the forming surface layer of the mandrel. Alternatively, the mandrel or its forming surface layer may be made of soluble materials, and the step of separating includes removing by chemical reaction with suitable solvents at least the forming surface of the mandrel.

The powdered form of the semiconductor material may consist of particulate matter of a size preferably ranging from 50 to 100 $\mu$m mean diameter. The method may be conducted in a non-oxygen environment, including in an inert gas environment such as in nitrogen or argon.

The method may include the step of directing a stream of cooling gas on the continuous layer as a way to maintain temperature control of the forming article and the mandrel. And the thermal spray apparatus may be a plasma spray gun or such other type of device described above.

As another example, there is a method for manufacturing a polysilicon tube including the steps of fabricating a mandrel with a tubular forming surface, rotating the mandrel about its axis within range of a thermal spray apparatus, supplying a powered form of silicon to the thermal spray apparatus, depositing on the tubular forming surface with the thermal spray apparatus a continuous layer of silicon until the polysilicon tube is complete, and separating the polysilicon tube from the mandrel.

While the invention has been described and illustrated in terms of preferred embodiments, it will be readily apparent to those skilled in the art that the method is susceptible of other embodiments as well, all within the scope of the claims that follow.

Among our claims are the following:

1. A method for manufacturing a thin wall tube of silicon comprising the steps of:

fabricating a mandrel with a forming surface conforming to a cylinder shape, keeping said forming surface in continuous motion with respect to a thermal spray apparatus, supplying said thermal spray apparatus with a powdered form of said silicon, depositing with said thermal spray apparatus a continuous layer of said powered form of said silicon on said forming surface whereby the continuous layer is maintained at not more than about 400° C. until said thin wall tube is complete, and separating said thin wall tube from said mandrel.

2. A method for manufacturing a formed article according to claim 1, said step of depositing comprising maintaining said continuous layer at not more than about 200° C.

3. A method for manufacturing a formed article according to claim 2, said mandrel being fabricated of materials having a higher coefficient of thermal expansion than said semiconductor material within the temperature range of about room temperature to about 200° C., said step of separating further comprising thermally contracting said forming surface of said mandrel away from said formed article.

4. A method for manufacturing a thin wall article according to claim 1, said step of fabricating a mandrel comprising fabricating said forming surface as an outer layer upon a mandrel spindle.

5. A method for manufacturing a thin wall article according to claim 1, said mandrel comprising materials having a substantially lower melting point than said formed article, said step of separating comprising melting at least said forming surface or said mandrel.

6. A method for manufacturing a formed article according to claim 1, said mandrel comprising soluble materials, said step of separating comprising removing by chemical reaction with suitable solvents at least said forming surface of said mandrel.

7. A method for manufacturing a formed article according to claim 1, said powdered form comprising particulate matter of a size ranging from 50 to 100 $\mu$m mean diameter.

8. A method for manufacturing a formed article according to claim 1, said method conducted in a non-oxygen environment.

9. A method for manufacturing a formed article according to claim 8, said non-oxygen environment comprising at least one of the group consisting of nitrogen and argon.

10. A method for manufacturing a formed article according to claim 1, further comprising the step of directing a stream of cooling gas on said continuous layer.

11. A method for manufacturing a formed article according to claim 1, said step of keeping said forming surface in continuous motion comprising rotation of said mandrel.

12. A method for manufacturing a formed article according to claim 1, said thermal spray apparatus being a plasma spray gun.

13. A method for manufacturing a polysilicon tube comprising the steps of:

fabricating a mandrel with a tubular forming surface, rotating said mandrel with respect to a thermal spray apparatus, supplying a powdered form of silicon to said thermal spray apparatus, depositing on said tubular forming surface with said thermal spray apparatus a continuous layer of silicon whereby the continuous layer is maintained at not more than about 400° C. until said polysilicon tube is complete, and separating said polysilicon tube from said mandrel.

14. A method for manufacturing a polysilicon tube according to claim 13, said mandrel being fabricated of materials having a higher thermal expansion than said polysilicon within the temperature range of about room temperature to about 200° C., said step of depositing further comprising maintaining said continuous layer at no more than about 200 degrees Centigrade, said step of separating comprising thermally contracting said forming surface of said mandrel away from said tube by lowering the temperature of both.

15. A method for manufacturing a polysilicon tube according to claim 13, said step of fabricating a mandrel comprising fabricating said forming surface as an outer layer upon a mandrel spindle, said step of separating said tube from said mandrel comprising removing said outer layer from between said tube and said mandrel spindle.

16. A method for manufacturing a polysilicon tube according to claim 13, said forming surface of said mandrel comprising materials having a substantially lower melting point than silicon, said step of separating comprising melting at least said forming surface of said mandrel.

17. A method for manufacturing a polysilicon tube according to claim 13, said forming surface comprising soluble materials, said step of separating comprising removing by chemical reaction with suitable solvents at least said forming surface of said mandrel.

18. A method for manufacturing a polysilicon tube according to claim 13, said powdered form comprising particulate matter ranging from about 50 to 100 $\mu$m mean diameter.

* * * * *